US010196251B2

(12) United States Patent
Kalogroulis et al.

(10) Patent No.: US 10,196,251 B2
(45) Date of Patent: Feb. 5, 2019

(54) WINE BOTTLE OPENER

(71) Applicant: Alexander Joshef Kalogroulis, Coulsdon, Surrey (GB)

(72) Inventors: Alexander Joshef Kalogroulis, Surrey (GB); Pat Y. Mah, Kowloon (HK)

(73) Assignee: Viatek Hong Kong Limited, Kowloon (HK)

( * ) Notice: Subject to any disclaimer, the term of this patent is extended or adjusted under 35 U.S.C. 154(b) by 414 days.

(21) Appl. No.: 14/900,300

(22) PCT Filed: Jun. 20, 2014

(86) PCT No.: PCT/GB2014/000242

§ 371 (c)(1),
(2) Date: Dec. 21, 2015

(87) PCT Pub. No.: WO2014/202939

PCT Pub. Date: Dec. 24, 2014

(65) Prior Publication Data

US 2016/0368749 A1 Dec. 22, 2016

(30) Foreign Application Priority Data

Jun. 22, 2013 (GB) ..... 1311139.8

(51) Int. Cl.
*B67B 7/04* (2006.01)
*B67B 1/04* (2006.01)

(52) U.S. Cl.
CPC ..... *B67B 7/0441* (2013.01); *B67B 7/04* (2013.01); *B67B 1/045* (2013.01); *B67B 7/0411* (2013.01)

(58) Field of Classification Search
CPC ... B67B 7/0441; B67B 7/0447; B67B 7/0411; B67B 7/0417; B67B 7/0405; B67B 7/04
USPC ..... 81/3.45
See application file for complete search history.

(56) References Cited

U.S. PATENT DOCUMENTS 5,095,778 A * 3/1992 Bocsi ..... B67B 7/0405 81/3.2
5,351,579 A * 10/1994 Metz ..... B67B 7/0405 30/1.5
5,724,869 A * 3/1998 May ..... B67B 7/0405 81/3.08

(Continued)

FOREIGN PATENT DOCUMENTS

CA 2388633 A1 * 5/2001 ..... B67B 7/0405
DE 4107567 A1 * 9/1992 ..... B67B 1/045

(Continued)

*Primary Examiner* — Joseph J Hail
*Assistant Examiner* — Arman Milanian
(74) *Attorney, Agent, or Firm* — Larry D. Johnson

(57) ABSTRACT

A manual bottle opener (1) that provides a means to slowly and steadily remove a stopper made from cork, foam or plastic, from a bottle by utilizing a gearbox (26) to allow a high number of low torque rotations of a handle (9) to be converted into a lower number of high torque rotations of a corkscrew (2). As a result the stopper is removed without any sudden change in pulling force and there is therefore a risk that the user will not realize that the stopper is out and keep turning the handle (9) and as a result damage the stopper. A corkscrew (2) locking method is therefore provided to protect the stopper and an overload clutch (16) is provided to protect the gearbox (26) and provide auditory feedback to the user.

13 Claims, 8 Drawing Sheets

(56) References Cited

U.S. PATENT DOCUMENTS

| | | | | |
|---|---|---|---|---|
| 6,752,041 | B2 * | 6/2004 | Lee | B67B 7/0405 81/3.2 |
| 2005/0217434 | A1 * | 10/2005 | Opolka | B67B 7/0417 81/3.37 |
| 2006/0185477 | A1 * | 8/2006 | Sun | B67B 7/0441 81/3.37 |
| 2010/0206136 | A1 * | 8/2010 | Cheung | B67B 7/0405 81/3.2 |
| 2011/0252924 | A1 * | 10/2011 | Federighi | B67B 7/0423 81/3.45 |

FOREIGN PATENT DOCUMENTS

| | | | | |
|---|---|---|---|---|
| FR | 23420898 | A1 * | 9/1977 | B67B 7/0441 |
| KR | 20080000784 | U * | 4/2008 | B67B 7/0405 |
| WO | WO 0204339 | A1 * | 1/2002 | B67B 7/0441 |

* cited by examiner

WINE BOTTLE OPENER

This invention relates to a device for extracting a cork from a bottle of wine.

Traditional manual wine openers take the form of a corkscrew that is screwed into the cork (or synthetic cork) and is then pulled directly by a handle. The extraction process is typically quite uncontrolled as a great deal of force needs to be exerted to start the cork moving against the stiction that has built up over time. Once the stiction is overcome the dynamic friction acting on the walls of the cork is considerably less. As a result, once the cork starts to move, it rapidly accelerates and comes out quite suddenly. Unfortunately some corks disintegrate during this process as the strength of the cork is not sufficient to keep it on the corkscrew as it drags against the wall of the bottle neck. Instead the cork will typically break and leave a portion still in the bottle. Any corkscrew portion that had been in the cork portion will rip out creating particles of cork that can contaminate the wine, especially as the cork is often left with a hole in it as the corkscrew rips out. Such a wine opener also requires a lot of strength to use.

Extracting the cork more slowly provides a means of reducing the chances of the cork being damaged and many wine openers use levers to provide more control and reduce the forces that need to be applied. However the lever type of wine opener with a good level of control is typically large and heavy and requires the user to exert a modest but controlled force onto a lever as it moves through a large arc of movement. Patent GB 2,401,860 is an example of such an invention.

Electric style wine openers rely on small and weak motors that have inadequate power ratings to suddenly extract a cork. Instead they extract the cork in a slow and steady manner which has very little chance of damaging the cork as the extraction rate does not change very much once stiction is overcome. Electric wine openers typically use a long corkscrew that is first screwed into the cork using the lower half. As the corkscrew continues to rotate and the wine opener is held steady relative to the wine bottle, the cork is drawn up the corkscrew until it is fully removed from the wine bottle (splines in the wine opener stop the cork from rotating as it is pulled up the corkscrew). As it reaches the top of the corkscrew it pushes against a cork sensor that breaks the electric circuit between the battery and the motor so that rotation stops. If the corkscrew did not stop rotating, the motor would either stall (which is bad for the motor and battery) or the corkscrew would drill a hole through the cork thereby destroying it and releasing cork debris into the wine bottle. U.S. Pat. No. 6,752,041 is a good example of such an invention.

What is provided in this invention is a manual wine opener that withdraws the cork in a slow and steady manner to that the cork is not overstressed during extraction and also protects the cork from unwanted damage after it has been extracted. Furthermore the input force required from the user is very low.

The invention will now be described solely by way of example and with reference to the accompanying drawings in which:

FIG. 1 shows a perspective view of wine opener 1 with the lower housing 3, upper housing 7 and handle housing 13 sectioned to reveal the inner components.

Figure 5:
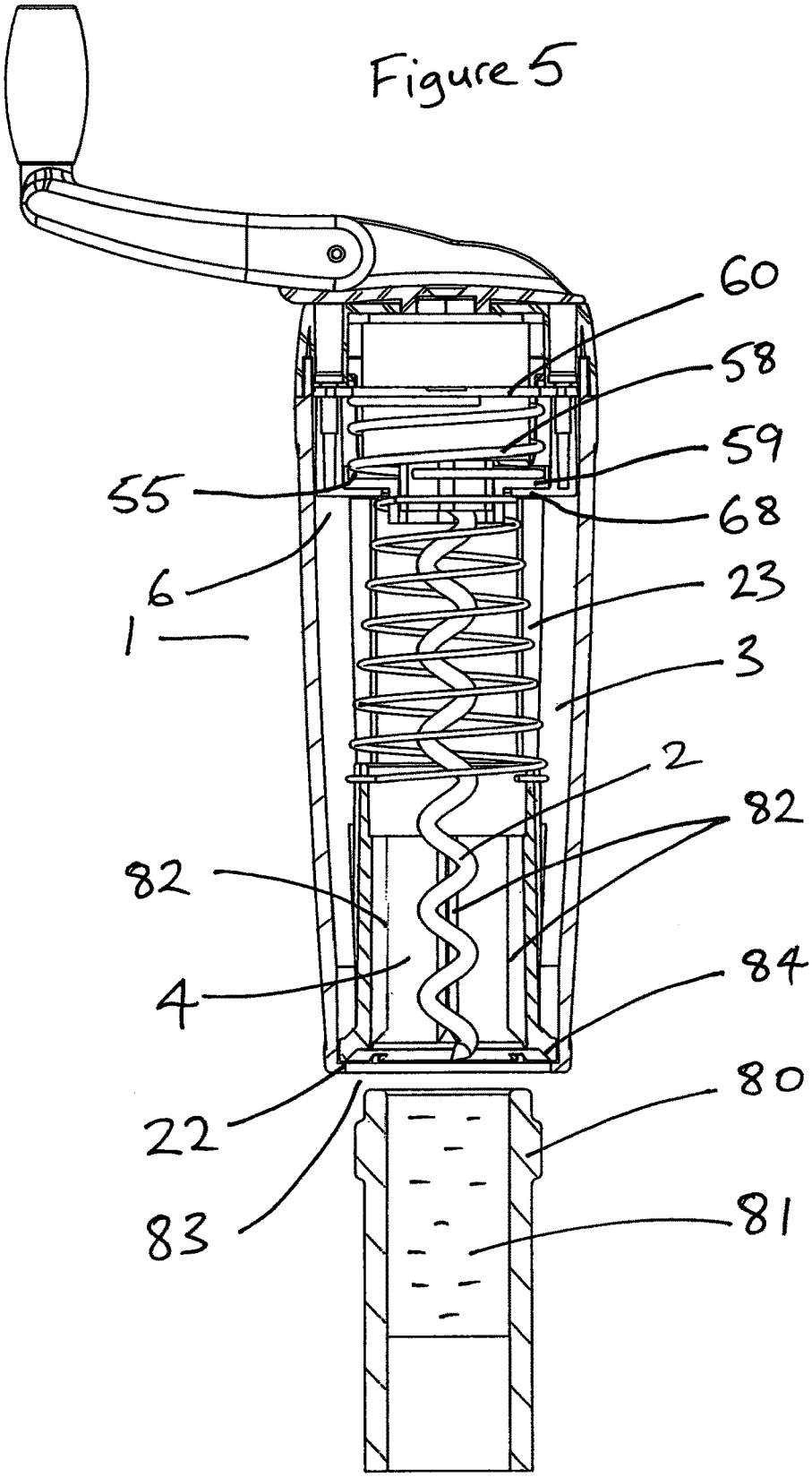

FIG. 5 shows a section through the lower housing 3, slider 4, lock plate 6, cork sensor 55, cork and wine bottle neck 80 as the corkscrew 2 is placed above a cork 81 in a wine bottle neck 80.

Figure 6:
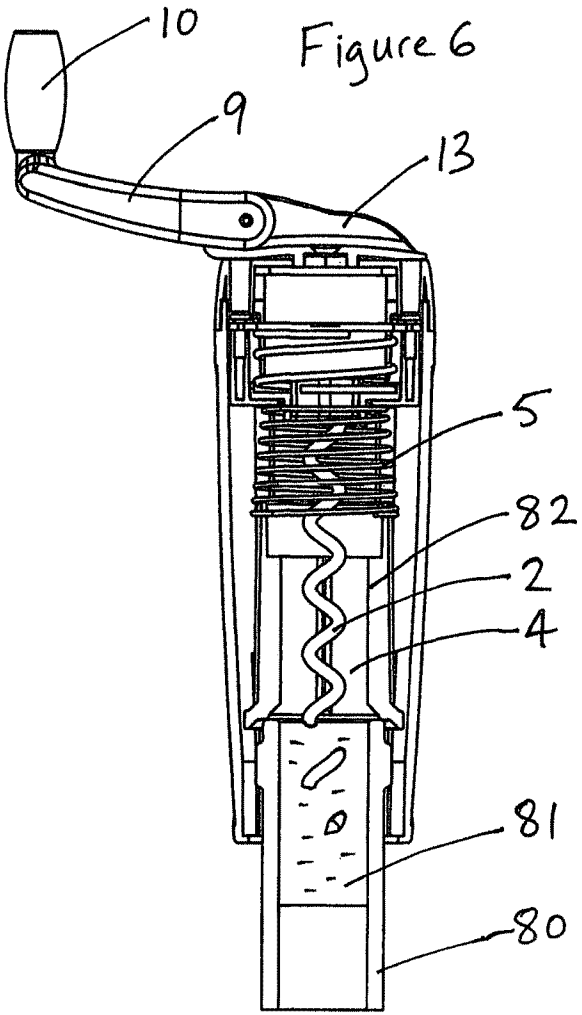

FIG. 6 shows the wine opener 1 of FIG. 5 as the corkscrew 2 starts to wind into the cork 81.

Figure 7:
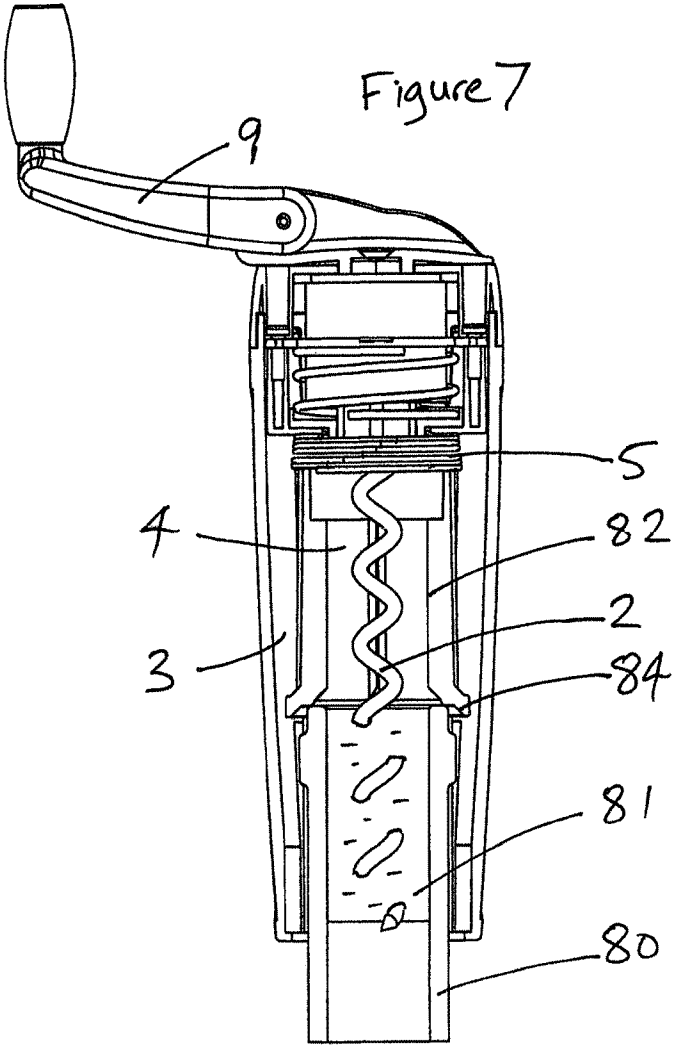

FIG. 7 shows the wine opener 1 of FIG. 5 with the corkscrew 2 fully wound into the cork 81.

Figure 8:
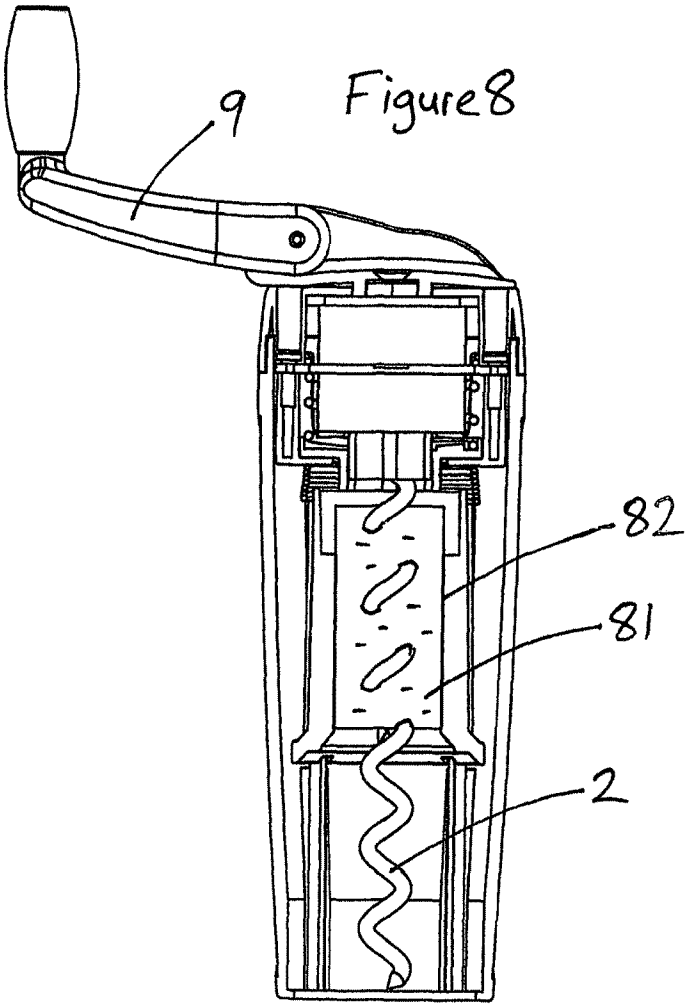

FIG. 8 shows the wine opener 1 of FIG. 5 with the tapered spring 5 and short shown 58 in section for clarity and with the cork 81 fully extracted from the wine bottle neck 80 which is no longer shown.

Figure 9:
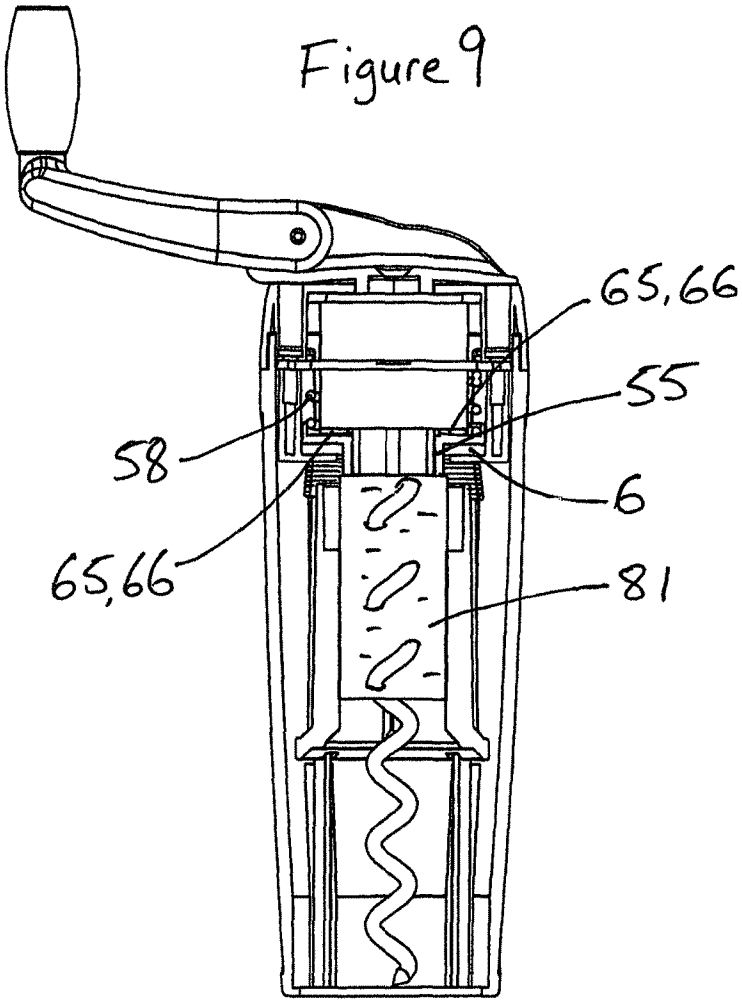

FIG. 9 shows the wine opener 1 of FIG. 8 with cork 81 having been extracted too far up the corkscrew 2 so that it has activated the overload system.

Figure 10:
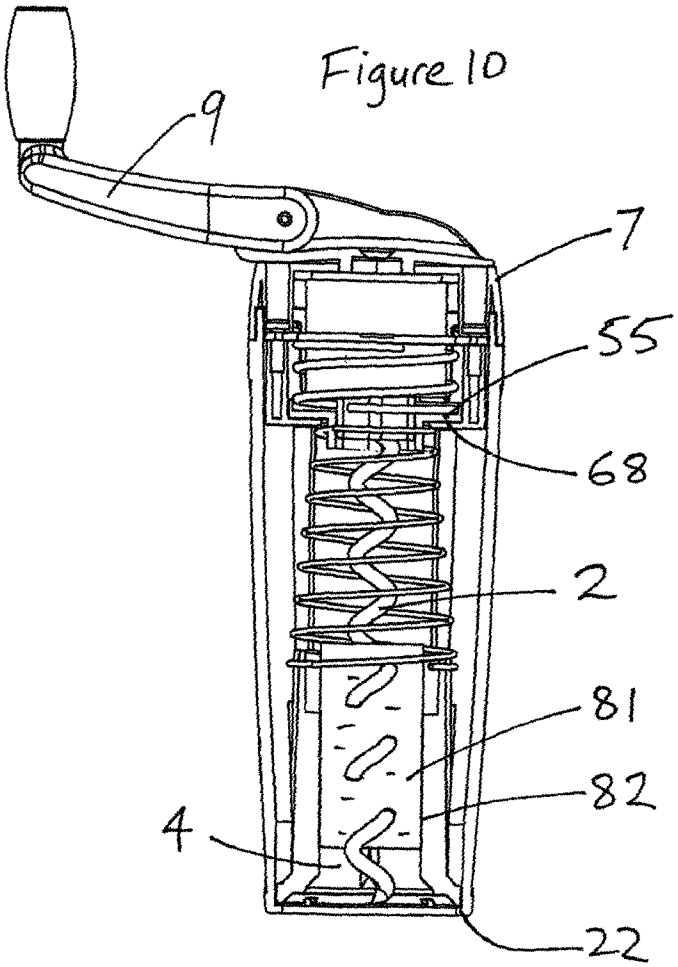

FIG. 10 shows the wine opener 1 of FIG. 8 with tapered spring 5 and short spring 58 fully shown and with the cork 81 semi expelled.

Figure 1:
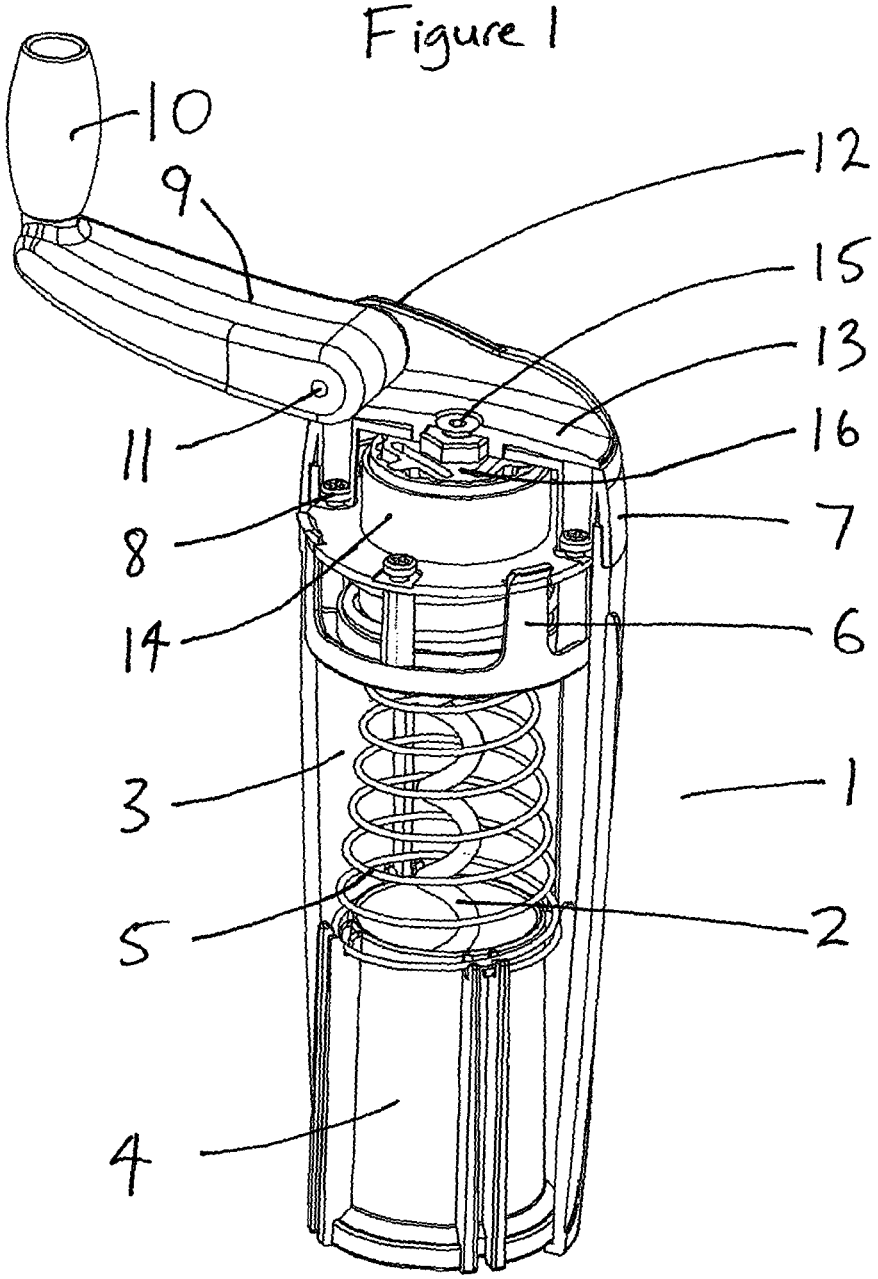

Referring to FIG. 1, a wine opener 1 consists of a lower housing 3 containing a right handed corkscrew 2 that can rotate within it, a slider 4 at the bottom and a tapered spring 5 that pushes the slider 4 towards the bottom of the lower housing 3. At the top of the lower housing 3 is a lock plate 6 to which is attached upper housing 7 by screws 8 which also pass through annulus 14. A handle 9 with a rotating knob 10 at one end is hinged at the opposite end by pin 11 that passes through a symmetrical pair of upstands 12 on handle housing 13. Countersunk screw 15 secures handle housing 13 to overload clutch 16 but with them able to rotate freely relative to upper housing 7.

Figure 2:
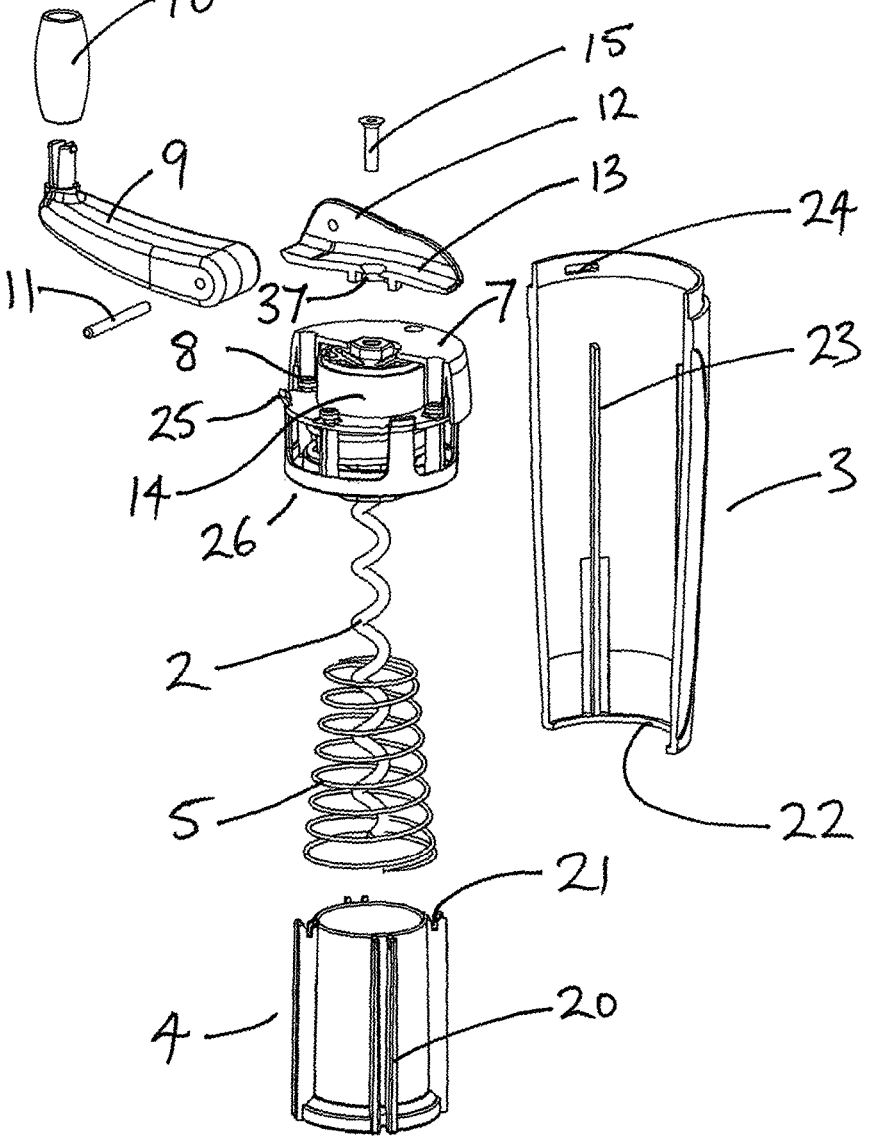
FIG. 2 shows a partially exploded perspective view of the wine opener 1 of FIG. 1.

Referring to FIG. 2, the lower housing 3 has a lower lip 22 to prevent the slider 4 sliding out from it, four long guide ribs 23 to stop the slider 4 rotating within lower housing 3 by being trapped within eight short ribs 20, and four slots 24 that receive four tabs 25 on the lock plate 6 to anchor it to the lower housing 3. The slider 4 has channels 21 at the top of each short rib 20 that receive the larger diameter end of tapered spring 5. The gearbox assembly 26 is shown in more detail in FIG. 3.

Figure 3:
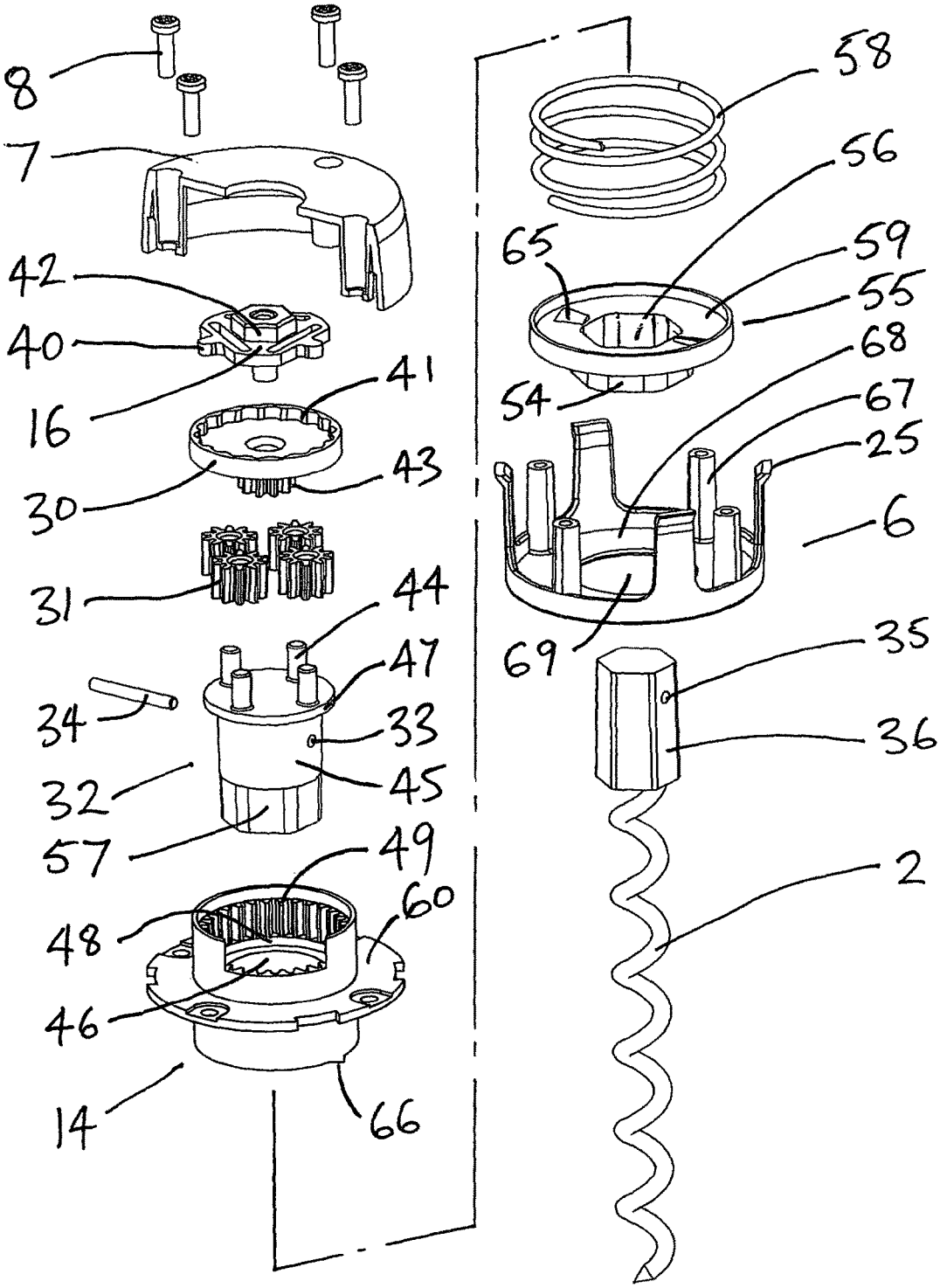
FIG. 3 shows an exploded perspective view of the gearbox assembly 26 and clutch system with a half section of the upper housing 7.

Referring to FIG. 3, an exploded view of the gearbox assembly 26 will be described from top to bottom. Assembly screws 8 pass through upper housing 7 to secure it to lock plate after passing though annulus 14. Overload clutch 16 has three sprung bumps 40 that can slip along multiple ridges 41 within sun drive 30 if excess torque is delivered to the overload clutch 16 by the knob 10 and handle 9 of the wine opener 1. A hexagonal boss 42 engages with a matching hexagonal recess 37 on the underside of handle housing 13 (see FIG. 2) to ensure that there is no slippage between these parts.

A sun gear 43 is attached to the underside of sun drive 30 and engages with four planetary gears 31 which rotate freely on posts 44 of carrier 32. A pin 34 is provided to secure corkscrew over moulding 36 within the carrier by passing through carrier pinhole 33 and over moulding pin hole 35 so that the corkscrew 2, corkscrew over moulding 36, carrier 32 and pin 34 all rotate together and are axially locked together. A carrier bearing surface 45 is provided to rotate freely against annulus bearing surface 46 within annulus 14. The underside of carrier plate 47 locates against a corresponding axial bearing surface 48 in the annulus (shown in scrap section) so that the carrier plate 47 is axially restrained from downwards movement within annulus 14. Annulus teeth 49 are visible inside annulus 14.

A cork sensor 55 is shown with a hexagonal through hole 56 that can axially slide freely on hexagonal wall 57 of carrier 32 but not rotate on it. A short spring 58 fits between the top surface of cork sensor flange 59 and the underside of annulus flange 60 and keeps pair of cork sensor teeth 65 apart from pair of annulus teeth 66 (more clearly seen in FIG. 4).

Lock plate 6 provides four tabs 25 and four screw bosses 67 that receive screws 8, a lock plate flange 68 with lock plate hole 69 within which hexagonal projection 54 can freely rotate. The lower surface of cork sensor flange 59 rests on and can freely slide on upper surface of lock plate flange 68.

Figure 4:
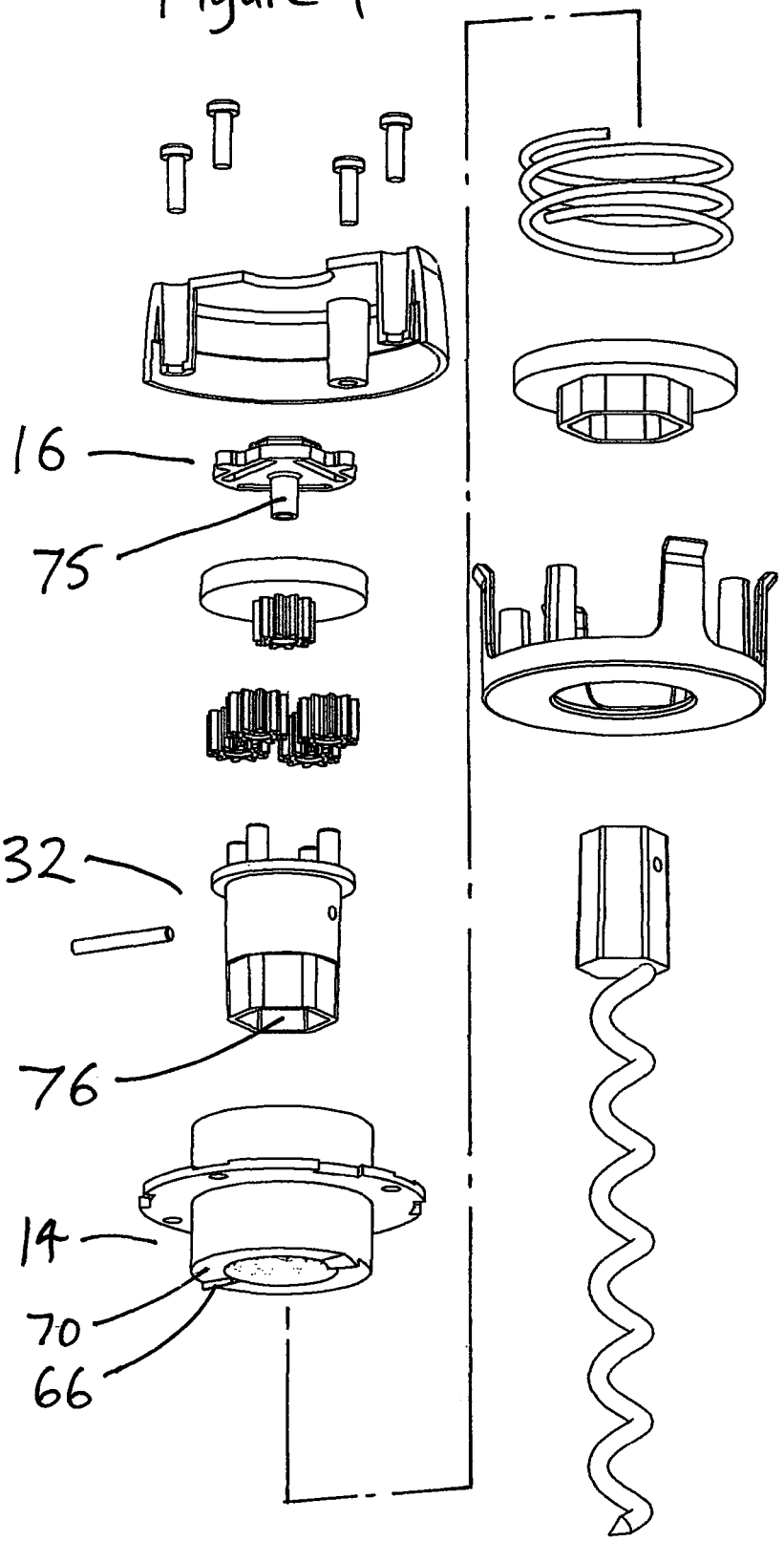
FIG. 4 shows a perspective view of the components in FIG. 3 from the underside.

Referring to FIG. 4, a number of features not clearly visible in FIG. 3 are described. Countersunk screw boss 75 is shown on the underside of overload clutch 16 to receive countersunk screw 15. Hexagonal chamber 76 in carrier 32 ensures a non rotating fit with corkscrew over moulding 36. A pair of annulus teeth 66 are clearly visible on bottom annulus face 70 on the underside of annulus 14.

For the description below, the extraction direction is the direction of rotation of the corkscrew 2 that would allow it to wind into a cork and the expulsion direction is the opposite direction that would wind the corkscrew 2 out of a cork. For a right handed corkscrew, the extraction direction would be clockwise when viewed from above the cork.

The pair of annulus teeth 66 and pair of cork sensor teeth 65 are chamfered as shown so that the teeth will lock against each other if the cork sensor plate 55 is pushed against and rotated in the extraction direction relative to the stationary annulus 14 yet slip over each other and allow relative rotary motion if rotated in the expulsion direction.

In FIG. 5 the wine opener 1 is shown above a wine bottle neck 80 and a cork 81. Three of four splines 82 are visible on the inside of the slider 4 and the tapered spring 5 can be seen between the lock plate 6 and the slider 4 which is urged downwards as a result and rests on lower lip 22 at the base of the lower housing 3. Long guide rib 23 stops rotation of slider 4 as previously described. An aperture 83 in the bottom of lower housing 3 allows the wine opener 1 to be placed over the wine bottle neck 80 and the tapered mouth 84 of slider 4 will rest on it.

Short spring 58 can be seen sitting between annulus flange 60 and cork sensor flange 59, lightly pressing cork sensor 55 against lock plate flange 68. Cork sensor teeth 65 and annulus teeth 66 (not clearly visible) cannot make contact at this stage as the bottom annulus face 70 and upper face of the cork sensor flange 59 are spaced apart by short spring 58.

Referring to FIG. 6 and FIG. 3, a situation is shown in which the wine opener 1 has been placed onto wine bottle neck 80 and cork 81 and the knob 10 has been rotated, clockwise when viewed from above, about the longitudinal axis of wine opener 1, the lower housing 3 being held to provide a counter torque via lock plate 6 and annulus 14. As the knob 10 is rotated, the handle 9 and handle housing 13 transmit rotary motion to overload clutch 16 which will not slip in sun drive 30 under normal operating conditions. As a result, sun gear 43 rotates and turns planetary gears 31 within annulus teeth 49 causing carrier 32 to rotate due to the resultant motion of the planetary gears 31 acting on posts 44. Carrier 32 will rotate much more slowly than the rotary speed of the knob 10 and handle 9 due to the epicyclic gear ratio between the sun gear 43 and the annulus teeth 49 (4:1 in this embodiment). As the corkscrew 2 is connected to carrier 32 by pin 11, it also rotates and will start to wind itself into cork 81 when it is brought into contact with it. After approximately 8 rotations of handle 9 the corkscrew 2 will have rotated twice and wound its way substantially into cork 81. As tapered spring 5 is quite weak, it compresses axially to allow the wine bottle neck 81 and cork 80 to move up into the lower housing 3 as the slider 4 moves upwards. Cork 81 has not yet started to be extracted.

Referring to FIG. 7, continuing to rotate handle 9 allows the corkscrew 2 to wind far enough into cork 81 that the tapered spring 5 has been completely compressed by the movement of slider 4 into the lower housing 3. At this stage slider 4 cannot move upwards any further and any further rotation of the corkscrew 2 will start to extract cork 81 from wine bottle neck 80 which cannot move upwards as it is pressed hard against tapered mouth 84 of slider 4.

Referring to FIG. 8, the cork 81 has now been fully extracted from wine bottle neck 80. As it has been drawn upwards along the corkscrew 2 it has been pinched on its outer circumference by splines 82. As a result cork 81 cannot rotate with corkscrew 2, even when it has been completely extracted from wine bottle neck 80. At this stage the wine bottle can be removed and the handle 9 turned in the opposite direction to expel the cork 81. However, if the user continues to turn the handle 9 in the same direction, the cork will continue to rise along the corkscrew 2.

Referring to FIG. 9, the cork 81 has now risen high enough on corkscrew 2 to activate the cork sensor 55 which is pushed upwards, compressing short spring 58. As a result, rotating cork sensor teeth 65 and stationary annulus teeth 66 come into contact and lock (the cork sensor teeth 65 are mounted on the cork sensor 55 which is rotating with corkscrew 2 and carrier 32 due to the hexagonal through hole 56 being driven by hexagonal wall 57, whilst annulus 14 is stationary as it is connected to the lower housing 3 via lock plate 6). When the teeth lock sun drive 30 can no longer rotate and instead the overload clutch 16 starts to turn within it with sprung bumps 40 jumping ridges 41 providing a feedback to the user in the form of a clicking sound. The user then knows that the cork 81 has been fully extracted and stops turning handle 9. This overload system protects the cork 81 from being drilled through by corkscrew 2 and also protects the various gears in the gearbox assembly 26 from excessive overload.

Referring to FIG. 10, the handle 9 is now being turned anti clockwise to expel cork 81. When expulsion started, if cork sensor teeth 65 and annulus teeth 66 had been in a locked condition, within the first half rotation of corkscrew 2 it would wind cork 81 downwards sufficiently to allow short spring 58 to push cork sensor 55 back down until it rests against lock plate flange 68 and the teeth would be no longer locked. (It should be noted that if numerous locking teeth were present then it would be difficult to disengage them because as the cork sensor 55 turned anticlockwise and the cork 81 moved down corkscrew 2, the teeth would not have been permitted to be moved far enough apart by short spring 58 before subsequent teeth reengaged.) Continued rotation of handle 9 in an anticlockwise direction pushes the cork 81 and slider 4 down the inside of lower housing 3 until slider 4 rests against lower lip 22 as shown. Further rotation of handle 9 would now start to expel cork 81 from slider 4 as it travels along corkscrew 2, until to slip and rotate by splines 82. Axial force transmitted up the corkscrew 2 during this stage is passed into carrier 32 via pin 34 and then into sun drive 30 via planetary gears 31 and posts 44. Sun drive 30 then passes the axial force into the inner surface of upper housing 7.

The resulting wine opener therefore provides a means to slowly and steadily remove a cork from a wine bottle by utilising an epicyclic gearbox to allow a high number of low torque rotations of a handle to be translated into a lower number of rotations of a corkscrew. The cork is removed without any sudden change in pulling force and there is therefore a risk that the user will not realise that the cork is out and therefore keep turning and damage the cork. A locking method is therefore provided to protect the cork and an overload clutch is provided to protect the gearbox and provide auditory feedback to the user.

In second embodiment, the sun drive is made from a sonorous material such as metal so that the overload clutch makes a pleasant 'ting' sound similar to a bicycle bell when it is overloaded.

While the preferred embodiments of the invention have been shown and described, it will be understood by those skilled in the art that changes or modifications may be made to them without departing from the true spirit and scope of the invention.

We claim:

1. A manual bottle opener for extracting a stopper from a bottle that comprises; a hollow housing with an open lower end, a rotatable handle supported by the housing that can be rotated in a first direction and a second direction, a rotatable corkscrew mounted inside the housing driven by the rotatable handle that, when the rotatable handle is turned in a first direction, can be wound into the stopper of a bottle to draw the stopper out of the bottle and along the corkscrew, or when the rotatable handle is turned in a second direction, pushes the stopper in the opposite direction along the corkscrew, and characterized by; a fixed plate within the housing through which the rotatable corkscrew passes, a stopper sensor that alerts the user that the stopper has travelled sufficiently far along the corkscrew that it is no longer stuck in the bottle, the stopper sensor rotating with the corkscrew and able to move axially along it, in which the stopper sensor is pushed axially by the stopper when the stopper has travelled sufficiently far along the corkscrew that it is no longer stuck in the bottle, in which the stopper sensor, when pushed axially by the stopper on the corkscrew, presses up against the fixed plate in the housing and then cannot move any further axially and as a result stops the corkscrew from further rotation in the direction that extracts the stopper from the bottle; in which the fixed plate and the stopper sensor have interlocking contact surfaces that lock in one rotary direction only and arranged so that when the stopper moving along the corkscrew pushes the stopper sensor against the fixed plate, the rotation is stopped by the interlocking contacts, but when the rotation of the corkscrew reverses, the stopper sensor can once again rotate so the stopper moves away from the stopper sensor.

2. The bottle opener of claim 1 in which the interlocking contact surfaces that lock in one rotary direction only are provided by at least one interlocking tooth on each surface that each have a first substantially vertical face and a second inclined face so that when the substantially vertical faces of each tooth abut there can be no relative motion in that first rotary direction but when the stopper sensor turns in the second rotary direction and the stopper moves away from the stopper sensor, the pair of inclined faces allow the stopper sensor to slide over the fixed plate and move away from it.

3. The bottle opener of claim 2 in which a first spring element is placed between the fixed plate and the stopper sensor so that the stopper sensor is not able to contact the fixed plate unless the first spring element is compressed by the stopper sensor being axially moved towards the fixed plate by the stopper as it travels along the corkscrew.

4. The bottle opener of claim 1 in which a reduction gearbox is positioned between the rotatable handle and the corkscrew so that the rotatable handle rotates between 2 and 6 times for each corkscrew rotation.

5. The bottle opener of claim 4 in which the gearbox is of a planetary gear type.

6. The bottle opener of claim 1 in which at least one spline is fixed to the inside of the housing so that it presses into the stopper as it is withdrawn by the corkscrew and stops the stopper rotating.

7. The bottle opener of claim 1 in which the housing contains a sliding tube that can slide axially up and down but not rotate within it and a lip at the open lower end that stops the sliding tube from sliding out, the sliding tube having at least one spline fixed to its inside surface so that it presses into the stopper as it is withdrawn by the corkscrew and stops the stopper rotating.

8. The bottle opener of claim 7 in which a second spring element within the housing pushes the sliding tube towards the bottom of the housing.

9. The bottle opener of claim 1 in which the rotatable handle comprises a handle housing that drives the corkscrew and a handle that pivots relative to the handle housing so that the handle can be folded to reduce the overall size of the bottle opener.

10. The bottle opener of claim 4 in which the fixed plate forms part of the gearbox housing within the housing.

11. A manual bottle opener for extracting a stopper from a bottle that comprises; a hollow housing with an open lower end, a rotatable handle supported by the housing that can be rotated in a first direction and a second direction, a rotatable corkscrew mounted inside the housing driven by the rotatable handle that, when the rotatable handle is turned in a first direction, can be wound into the stopper of a bottle to draw the stopper out of the bottle and along the corkscrew, or when the rotatable handle is turned in a second direction, pushes the stopper in the opposite direction along the corkscrew, and characterized by; a fixed plate within the housing through which the rotatable corkscrew passes, a stopper sensor that alerts the user that the stopper has travelled sufficiently far along the corkscrew that it is no longer stuck in the bottle, the stopper sensor rotating with the corkscrew and able to move axially along it, in which an overload clutch is placed between the rotatable handle and the corkscrew, the overload clutch transmitting torque from the rotatable handle to the corkscrew in order to extract the stopper from a bottle but slipping if the corkscrew has been locked against rotation by the stopper sensor having been pressed against the fixed plate and the user forcing the rotatable handle to turn anyway.

12. The bottle opener of claim 11 in which the overload clutch makes an audible clicking sound when it slips.

13. The bottle opener of claim 11 in which the overload clutch makes a ringing sound when it slips.

* * * * *